US005801733A

United States Patent [19]

Pankert

[11] Patent Number: 5,801,733

[45] Date of Patent: Sep. 1, 1998

[54] INK JET RECORDING DEVICE

[75] Inventor: Joseph R.R. Pankert, Aachen, Germany

[73] Assignee: U.S. Philips Corporation, New York, N.Y.

[21] Appl. No.: 928,012

[22] Filed: Sep. 11, 1997

Related U.S. Application Data

[63] Continuation of Ser. No. 566,528, Dec. 4, 1995, abandoned.

[30] Foreign Application Priority Data

Dec. 5, 1994 [EP] European Pat. Off. ..... 94203526

[51] Int. Cl.[6] ..... B41J 2/045

[52] U.S. Cl. ..... 347/72

[58] Field of Search ..... 347/40, 71, 72, 347/68, 54, 20; 310/311, 313 R, 313 A, 325

[56] References Cited

U.S. PATENT DOCUMENTS

| | | | |
|---|---|---|---|
| 3,946,398 | 3/1976 | Kyser et al. | 346/1 |
| 4,599,628 | 7/1986 | Doring et al. | 347/71 |
| 4,611,219 | 9/1986 | Sugitani et al. | 346/140 R |

FOREIGN PATENT DOCUMENTS

| | | |
|---|---|---|
| 0145066 | 6/1985 | European Pat. Off. . |
| 0516188 | 12/1992 | European Pat. Off. . |

*Primary Examiner*—Benjamin R. Fuller
*Assistant Examiner*—Juanita Stephens
*Attorney, Agent, or Firm*—Robert McDermott

[57] ABSTRACT

The device comprises a recording head including: a chamber plate having oppositely situated first and second faces, pressure chambers being formed as through holes extending between the first and second faces of the chamber plate, the pressure chambers being arranged in substantially parallel first and second rows; a nozzle plate attached to one of the faces of the chamber plate, said nozzle plate comprising a number of nozzle openings corresponding to the number of pressure chambers, each nozzle opening communicating with one of the pressure chambers; a piezoelectric actuator element associated with each pressure chamber, said actuator element having an active direction and comprising at least one layer of piezoelectric material and at least two electrode layers which are arranged such that the dimension of the actuator element in the active direction is varied upon application of an electric voltage between the electrode layers, the actuator element being arranged in cooperative relationship with the associated pressure chamber so that the pressure chamber changes its volume when the dimension of the actuator element in the active direction is varied. The recording head further comprises ink supply means provided at the faces of the chamber plate, said ink supply means comprising four ducts extending substantially parallel to the rows of pressure chambers, each pressure chamber communicating with the ink supply means via an ink supply channel. The first and second ducts are provided at the first face of the chamber plate and the third and fourth ducts are provided at the second face of the chamber plate. The second, fourth, sixth, etcetera pressure chambers of the first row communicate with the first duct, the second, fourth, sixth, etcetera pressure chambers of the second row communicate with the second duct, the first, third, fifth, etcetera pressure chambers of the first row communicate with the third duct, and the first, third, fifth, etcetera pressure chambers of the second row communicate with the fourth duct. As a result, full colour printing is possible with only one recording head.

17 Claims, 3 Drawing Sheets

INK JET RECORDING DEVICE

This is a continuation of application Ser. No. 08/566,528, filed on Dec. 4, 1995, now abandoned.

BACKGROUND OF THE INVENTION

The invention relates to an ink jet recording device including a recording head comprising:

- a chamber plate having oppositely situated first and second faces, pressure chambers being formed as through holes extending between the first and second faces of the chamber plate, the pressure chambers being arranged in substantially parallel first and second rows;
- ink supply means provided at least one of the faces of the chamber plate, said ink supply means comprising a duct extending substantially parallel to the rows of pressure chambers and ink supply channels, each pressure chamber communicating with the ink supply means via one of the ink supply channels;
- a nozzle plate attached to one of the faces of the chamber plate, said nozzle plate comprising a number of nozzle openings corresponding to the number of pressure chambers, each nozzle opening communicating with one of the pressure chambers for emitting droplets of ink;
- a piezoelectric actuator element associated with each pressure chamber, said actuator element having an active direction and comprising at least one layer of piezoelectric material and at least two electrode layers which are arranged such that the dimension of the actuator element in the active direction is varied upon application of an electric voltage between the electrode layers, the actuator element being arranged in cooperative relationship with the associated pressure chamber so that the pressure chamber changes its volume when the dimension of the actuator element in the active direction is varied.

Such a device is known from EP-B-0 145 066. The recording head of the known device comprises a chamber plate with two rows of pressure chambers, a duct being provided at one of the faces of the chamber plate. A nozzle plate is attached to one of the faces of the chamber plate and a membrane plate is attached to the opposite face. Piezoelectric actuator elements are provided on the membrane plate, each one of these actuator elements cooperating with one of the pressure chambers. This recording head is very compact and reliable. If an ink jet recording head for multicolor printing is desired, one of such recording heads would be necessary for each color to be recorded. It is usual for multicolor recording devices to use three basic colors (yellow, cyan and magenta) plus black. Consequently, four print heads would be necessary to make the known recording device suitable for multicolor printing. This would make the device substantially less compact.

SUMMARY OF THE INVENTION

It is an object of the invention to provide an ink jet recording device of the kind set forth that is suitable for multicolor recording even though it has only a single recording head. To achieve this object, the device in accordance with the invention is characterized in that the ink supply means comprise a plurality of ducts, each duct communicating with a subset of the pressure chambers. Preferably the plurality of ducts comprises first and second ducts provided at the first face of the chamber plate and third and fourth ducts provided at the second face of the chamber plate, the second, fourth, sixth, etcetera pressure chambers of the first row communicating with the first duct, the second, fourth, sixth, etcetera pressure chambers of the second row communicating with the second duct, the first, third, fifth, etcetera pressure chambers of the first row communicating with the third duct, and the first, third, fifth, etcetera pressure chambers of the second row communicating with the fourth duct. In the device in accordance with the invention the recording head comprises four different groups of pressure chambers, each group being connected to a different duct. Each duct can be supplied with ink of one of the four colors referred to above. A dot of a predetermined color can be printed by activating the actuator element associated with a selected one of the pressure chambers connected to a duct that contains ink of that color.

A preferred embodiment of the device in accordance with the invention is characterized in that the ducts and the associated ink supply channels provided at least one of the faces of the chamber plate are formed as recesses in that face of the chamber plate. The recesses can be formed together with the through holes forming the pressure chambers, which increases the efficiency of the manufacturing process.

A further embodiment is characterized in that the ducts and the associated ink supply channels provided at least one of the faces of the chamber plate are formed as recesses in a further plate attached to that face of the chamber plate. The further plate may be the nozzle plate, in which the recesses can be provided together with the nozzle openings. The further plate can also be a backing plate attached to the face of the chamber plate that is situated opposite the face to which the nozzle plate is attached.

A still further embodiment is characterized in that the ducts and the associated ink supply channels provided at least one of the faces of the chamber plate are formed as openings in an intermediate plate attached to that face of the chamber plate, the intermediate plate being sandwiched between the chamber plate and a further plate. An advantage of this embodiment is that the openings in the intermediate plate can be manufactured with great precision which is particularly advantageous for the ink supply channels that have to form narrow passages so as to prevent ink from flowing back to the duct upon the activation of the actuator element.

Preferably, the chamber plate is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate. This results in an extremely compact recording head because the actuator elements are integrated in the chamber plate. However, if the use of separate actuator elements is preferred, it is feasible to use an embodiment which is characterized in that a membrane plate is attached to the face of the chamber plate that is opposite the face to which the nozzle plate is attached, an actuator element being attached to the membrane plate at the location of each pressure chamber.

These and other aspects of the invention will be apparent from the embodiments described hereinafter.

DETAILED DESCRIPTION OF THE EMBODIMENTS

Figure 1:
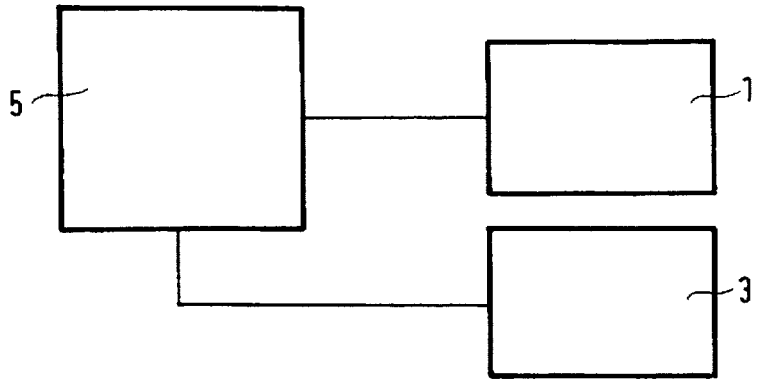
FIG. 1 is a simplified block diagram of an ink jet recording device in accordance with the invention.

Throughout the figures the same reference numerals have been used for corresponding elements. FIG. 1 is a block diagram showing only the most essential parts of an ink jet recording device in accordance with the invention. Such a device comprises an ink jet recording head 1, a paper transport mechanism 3 and a control unit 5. The general construction of ink jet printing devices is well known in the art, see for example U.S. Pat. No. 3,946,398. The device according to the invention differs from the known devices mainly in the construction of the recording head 1.

Figure 2:
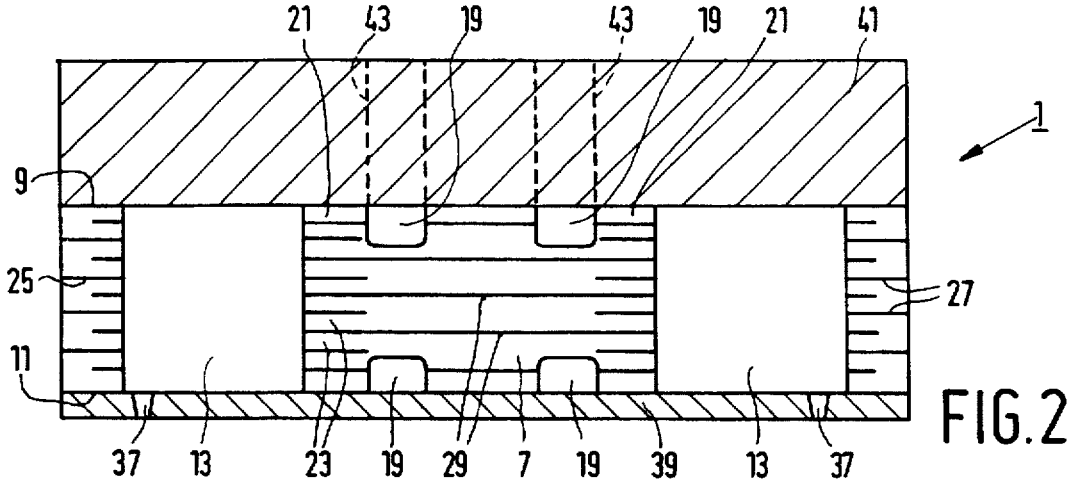
FIG. 2 is a cross-section (not to scale) of a first embodiment of a recording head for the device shown in FIG. 1.

FIG. 2 shows a cross-section of a first embodiment of a recording head 1 for the device of FIG. 1. It is to be noted that the figure is not to scale. For the sake of clarity some dimensions have been exaggerated. The recording head 1 comprises a chamber plate 7 with a first face 9 and a second face 11 opposite the first face. Pressure chambers 13 have been formed in the chamber plate 7, each pressure chamber consisting of a through hole that extends between the first face 9 and the second face 11. The pressure chambers 13 are arranged in two substantially parallel rows as can be seen in FIG. 3.

Figures 3A, 3B:
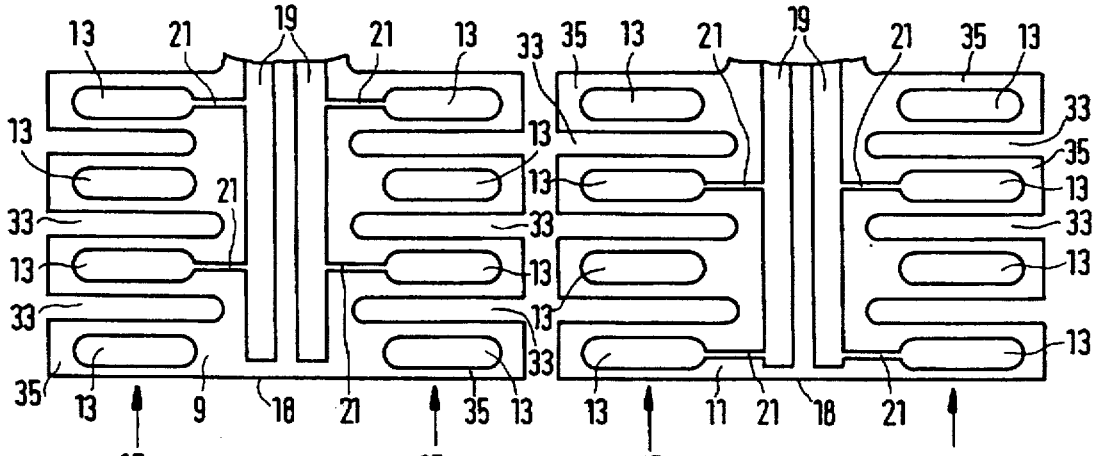
FIGS. 3A and 3B show a possible layout of the first and second faces of the chamber plate of the recording head shown in FIG. 2.

FIG. 3A shows the first face 9 and FIG. 3B shows the second face 11. FIG. 3A is a view which would be had from the top of FIG. 2. It can be seen clearly that the pressure chambers 13 are arranged in a first row 15 on the left-hand side of the figure and a second row 17 parallel to the first row on the right-hand side of the figure. The number of pressure chambers 13 in each row may be very large, for example 200. FIG. 3B is a view which would be obtained by rotating the chamber plate as shown in FIG. 3A over 180° about a line parallel to the direction of the first and second rows 15, 17. Consequently, in FIG. 3B the first row 15 is shown at the right-hand side and the second row 17 at the left-hand side. An edge 18 of the chamber plate 7 is shown at the bottom of FIGS. 3A and 3B. At the first and second faces 9, 11 of the chamber plate 7 ink supply means have been provided by forming recesses in these faces. These recesses have the form of ducts 19 and ink supply channels 21, each pressure chamber 13 being connected to one of the ducts by means of one of the ink supply channels. The ducts 19 extend substantially parallel to the rows 15, 17 of pressure chambers 13. At the first face 9 of the chamber plate 7 first and second ducts 19 are provided and at the second face 11 third and fourth ducts 19 are provided. The pressure chambers 13 in each one of the rows 15 and 17 can be numbered, starting with number 1 for the pressure chamber nearest the edge 18. It can easily be seen that the pressure chambers having the numbers two, four, six, etcetera in the first row 15 communicate with the first duct 19, the pressure chambers with the same numbers in the second row 17 communicate with the second duct 19, and that the pressure chambers with the numbers one, three, five, etcetera in the third and fourth rows communicate with the third and fourth ducts 19, respectively.

Figure 4:
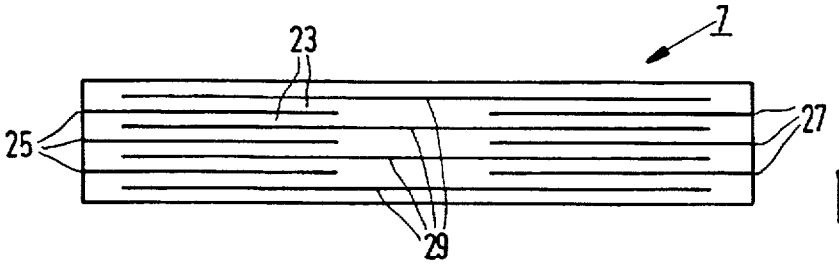
FIG. 4 shows a cross-section of a plate suitable for manufacturing a chamber plate for a recording head as shown in FIG. 2.
Figure 5:
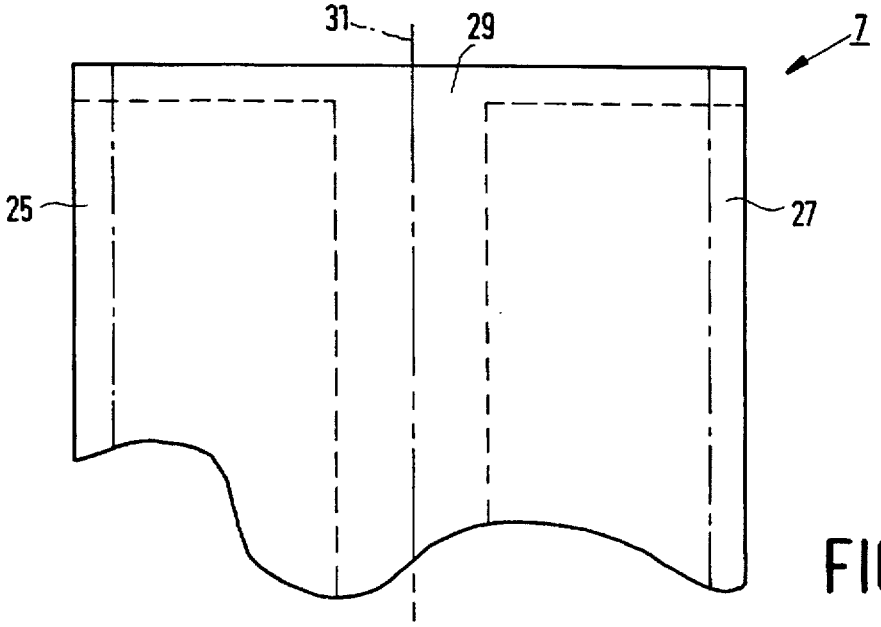
FIG. 5 shows a possible layout of the electrode layers of the plate shown in FIG. 4, and FIGS. 6, 7 and 8 are cross-sections similar to FIG. 2 of a second, a third and a fourth embodiment, respectively.

FIG. 4 shows a cross-section of the chamber plate 7 of the recording head of FIG. 2 before the pressure chambers and the ink supply means have been provided. This chamber plate is formed as a multilayer plate comprising a plurality of layers 23 of piezoelectric material (preferably a piezoelectric ceramic) alternated by electrode layers. There are three types of electrode layers, indicated with the reference numerals 25, 27 and 29. FIG. 5 is a view from above of the chamber plate shown in FIG. 4. In FIG. 5 the electrode layers 25 of the first type and the electrode layers 27 of the second type have been indicated in dotted lines and the electrode layers 29 of the third type have been indicated in dash-dot lines. From FIGS. 4 and 5 it is clear that the electrode layers 25 of the first type extend from the left-hand edge of the rectangular chamber plate 7 to a line left of the vertical center line 31. The electrode layers 27 of the second type extend from the right-hand edge of the chamber plate to a line right of the vertical center line 31 and the electrode layers 29 of the third type extend from the top edge in FIG. 5 downward over substantially the entire length of the chamber plate. The electrode layers 25, 27 of the first and second type do not extend to the top and bottom edges of the chamber plate 7 and the electrode layers 29 of the third type do not extend to the left-hand and right-hand edges of that plate. Consequently, electrical connections (not shown) can be made to the electrode layers 25 of the first type at the left-hand edge of the chamber plate 7, to the electrode layers 27 of the second type at the right-hand edge and to the electrode layers 29 of the third type at the top edge.

In FIG. 2 it can be seen that, after the pressure chambers 13 have been provided in the chamber plate 7 (for example by sawing, wet chemical etching, powder blasting or laser cutting), the pressure chambers 13 of the first row 15 are surrounded by electrode layers 25 of the first type and electrode layers 29 of the third type, the pressure chambers of the second row 17 being surrounded by electrode layers 27 of the second type and electrode layers 29 of the third type. In FIGS. 3A and 3B it can be seen that slits 33 are provided in the chamber plate 7. Each one of these slits extends between two adjacent pressure chambers 13 so that each pressure chamber is situated on a separate finger 35 formed in the chamber plate 7. The slits 33 extend far enough into the chamber plate 7 to interrupt the electrode layers 25 or 27 between adjacent pressure chambers 13 in a row 15 or 17. Consequently, each pressure chamber 13 is surrounded by its own electrode layers 25 or 27 of the first or second type which can be connected electrically to an individual terminal (not shown) at the free end of the relevant finger 35. In addition each pressure chamber 13 is surrounded by a number of electrode layers 29 of the third type, all electrode layers of the third type being connected together electrically. Together the electrode layers 25 (or 27) and 29 and the piezoelectric layers 23 that surround a pressure chamber 13 form a piezoelectric actuator element associated with that pressure chamber. Each such piezoelectric actuator element has an active direction that coincides with the direction of the thickness of the chamber plate 7 (the vertical direction in FIGS. 2 and 4). When an electric voltage is applied between the first electrode layers 25 (or the second electrode layers 27) and the third electrode layers 29, the dimension of the actuator element in the active direction is varied and, consequently, the volume of the associated pressure chamber 13 is varied. When the pressure chamber 13 expands, ink flows from the duct 19 via the ink supply channel 21 to the pressure chamber. When the pressure chamber 13 contracts, ink is ejected from the pressure chamber via a nozzle opening 37 in a nozzle plate 39 that is attached to the second face 11 of the chamber plate 7. A backing plate 41 is attached to the first face of the chamber plate 7 so that the pressure chambers 13 are closed with the exception of the nozzle openings 37 and the ink supply channels 21. Openings 43 (shown in dotted lines) may be provided in the backing plate 41 to connect the ducts 19 to ink reservoirs (not shown). Similar openings (not shown) may, of course, be provided in the nozzle plate 39. The dimension of the ink supply channels 21 is chosen such that ink cannot flow back to the duct 19 when the pressure chamber contracts. This operation of the recording head 1 has been explained in detail in the copending patent application . . . (PHN 15.079). If the camber plate 7 has a relatively large number of piezoelectric layers 23 sandwiched between electrode layers 25, 27, 29 a substantial change of the dimension of the actuator elements can be obtained with relatively low voltages between the electrode layers. Nevertheless, it is also possible to use a chamber plate comprising a single piezoelectric layer sandwiched between two electrode layers. In that case a higher voltage would be necessary to obtain the desired change in the dimension of the actuator elements.

In operation, the first, second, third and fourth ducts 19 are filled with inks of different colors, for example black, yellow, cyan and magenta. If an actuator element associated with one of the even-numbered pressure chambers 13 in the first row 15 is activated, a droplet of black ink will be ejected from the nozzle opening 37 of that pressure chamber. If an actuator element associated with an even-numbered pressure chamber 13 in the second row 17 is activated, a droplet of yellow ink will be ejected. Similarly, droplets of cyan or magenta ink will be ejected if actuator elements associated with odd-numbered pressure chambers 13 of the first row 15 or the second row 17, respectively, are activated. Consequently, full color printing is possible with the single recording head 1 shown in FIGS. 2 and 3.

Figure 6:
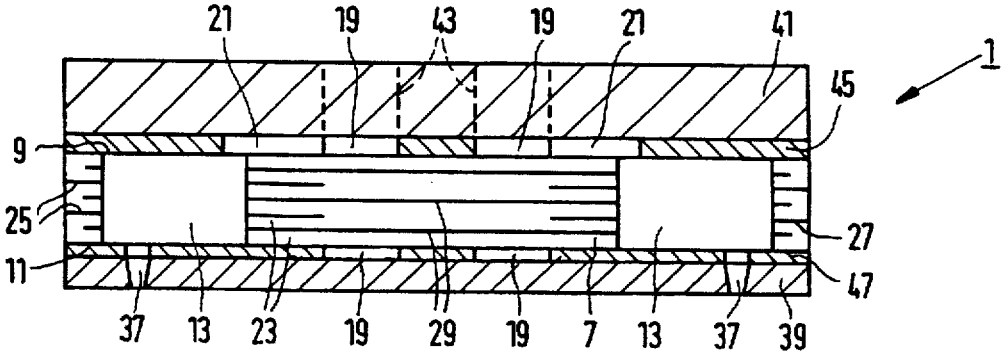

FIG. 6 shows a cross-section similar to FIG. 2 of a second embodiment of the recording head 1. In this embodiment the ducts 19 and the associated ink supply channels are formed as openings in intermediate plates 45 and 47 attached to the first and second faces 9 and 11, respectively of the chamber plate 7. The chamber plate 7, the nozzle plate 39 and the backing plate 41 may be similar to the corresponding plates of the first embodiment shown in FIG. 2. The intermediate plates 45, 47 may for example be metal plates in which the openings forming the ducts 19 and ink supply channels 21 have been formed by etching. The first intermediate plate 45 is sandwiched between the chamber plate 7 and the backing plate 41 and the second intermediate plate 47 is sandwiched between the chamber plate and the nozzle plate 39. The layout of the ducts 19 and the ink supply channels 21 in the first intermediate plate 45 may be the same as the layout shown in FIG. 3A and the layout in the second intermediate plate 47 may be the same as the layout shown in FIG. 3B. As a consequence, only the ink supply channels 21 in the first intermediate plate 45 are visible in FIG. 6.

Figure 7:
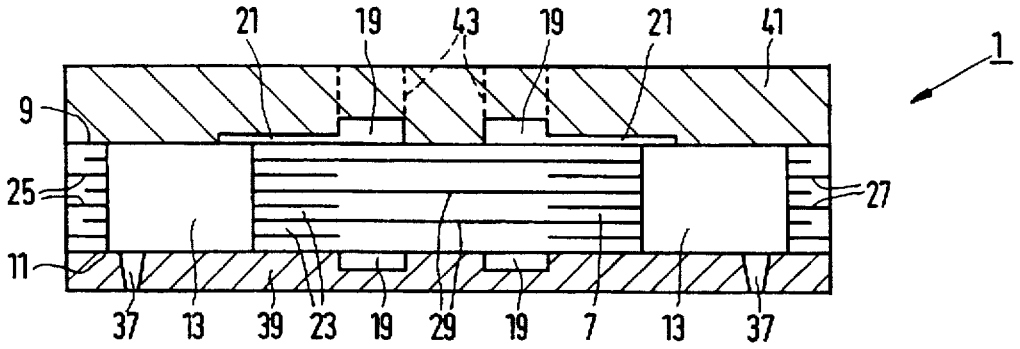

A cross-section of a third embodiment of the recording head 1 is shown in FIG. 7. In this embodiment the ducts 19 and the ink supply channels 21 are formed as recesses in the nozzle plate 39 and the backing plate 41. Because the layout of the ducts 19 and the ink supply channels 21 is the same as the layout shown in FIGS. 3A and 3B, only the ink supply channels provided in the backing plate 41 are visible in FIG. 7. The recesses in the nozzle plate 39 and the backing plate 41 are provided in the faces of these plates that are attached to the second face 11 and the first face 9 of the chamber plate 7, respectively.

Figure 8:
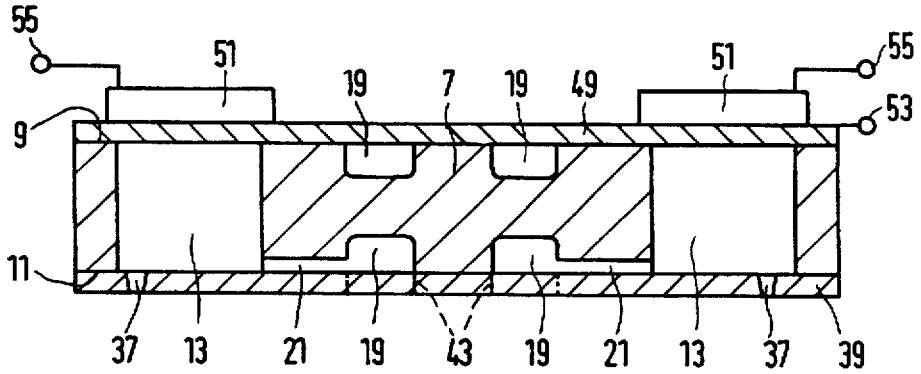

FIG. 8 shows a cross-section of a fourth embodiment of the recording head 1. In this embodiment the chamber plate 7 may be made of an inert (non-piezoelectric) material such as metal or a suitable plastics material. Similarly to the first embodiment shown in FIG. 2, pressure chambers 13, ducts 19 and ink supply channels 21 have been provided in the chamber plate 7. The layout of the ducts 19 and ink supply channels 21 may be the same as in the first embodiment. Only the ink supply channels 21 in the second face 11 of the chamber plate 7 are visible in FIG. 8. As in the previously described embodiments, a nozzle plate 39 is attached to the second face 11 of the chamber plate 7. A membrane plate 49 is attached to the first face 9 of the chamber plate 7. The membrane plate 49 may be a thin metal plate. At the location of each pressure chamber 13 an actuator element 51 is attached to the membrane plate 49. The actuator elements 51 may comprise one or more layers of piezoelectric material sandwiched between two electrode layers as disclosed in EP-A-0 516 188. It is also possible for the membrane plate 49 to comprise a metal layer facing the second face 11 of the chamber plate 7 and a piezoelectric layer on top of the metal layer. At the location of each pressure chamber 13 an area of increased thickness may then be formed on the piezoelectric layer, said area being covered at the other side with an electrode layer (not shown). Such a construction is described in detail in EP-B-0 145 066. In all variations a part of the electrode layers of the actuator elements 51 is commonly connected, via the metallic portion of the membrane plate 49, to a first terminal 53 and the remainder of the electrode layers is connected to a second terminal 55. One second terminal 55 is provided for each actuator element 51 so that each actuator element can be activated individually as in the previously described embodiments. Consequently, full color printing is possible with the recording head shown in FIG. 8.

It will be apparent to the skilled person that other embodiments of the invention than the ones described so far are feasible. For example, it would be possible to use an inert chamber plate 7 as shown in FIG. 8 in combination with intermediate plates 45, 47 as shown in FIG. 6. It is also possible to form the ducts 19 and ink supply channels 21 for example as recesses in the first face 9 of the chamber plate and in the nozzle plate 39 or an intermediate plate 47 provided between the nozzle plate and the second face 11 of the chamber plate. Other combinations of the described features are equally well possible.

I claim:

1. A recording head for an ink jet recording device comprising:

a chamber plate having oppositely situated first and second faces, means for supplying ink to at least one of the faces of the chamber plate, a plurality of pressure chambers being formed as through holes extending from the first and second faces of the chamber plate, the pressure chambers each having a volume, and being arranged in substantially parallel first and second rows, a plurality of ducts for communicating ink between said ink supply means and the pressure chambers, each duct communicating with at least one of the pressure chambers, and each pressure chamber communicating with only one of said ducts, a nozzle plate attached to one of the faces of the chamber plate, said nozzle plate comprising a number of nozzle openings corresponding to the number of pressure chambers, each nozzle opening communicating with one of the pressure chambers for emitting droplets of ink, a piezoelectric actuator element integral to the chamber plate and surrounding each pressure chamber, said actuator element having an active direction, said actuator element comprising:

at least one layer of piezoelectric material having an active dimension, and at least two electrode layers, said piezoelectric material and electrode layers being arranged such that, upon application of an electric voltage between the electrode layers, the active dimension of the piezoelectric material is varied in the active direction, and the actuator element is arranged in cooperative relationship with the surrounded pressure chamber so as to cause a change of volume of the pressure chamber when the active dimension of the actuator element is varied in the active direction.

2. An ink jet recording device including a recording head, said recording head comprising:

a chamber plate having oppositely situated first face and second face, means for supplying ink to at least one of the first and second face of the chamber plate, a plurality of pressure chambers being formed as through holes extending from the first face and second face of the chamber plate, the pressure chambers each having a volume, and being arranged in substantially parallel first and second rows, a plurality of ducts for communicating ink between said ink supply means and the pressure chambers, each duct communicating with at least one of the pressure chambers, and each pressure chamber communicating with only one of said ducts, a nozzle plate attached to one of the first and second face of the chamber plate, said nozzle plate comprising a number of nozzle openings corresponding to the number of pressure chambers, each nozzle opening communicating with one of the pressure chambers for emitting droplets of ink, a piezoelectric actuator element integral to the chamber plate and surrounding each pressure chamber, said actuator element having an active direction, said actuator element comprising:

at least one layer of piezoelectric material having an active dimension and at least two electrode layers, said piezoelectric material and electrode layers being arranged such that, upon application of an electric voltage between the electrode layers, the active dimension of the piezoelectric material is varied in the active direction, and the actuator element is arranged in cooperative relationship with the surrounded pressure chamber so as to cause a change of volume of the pressure chamber when the active dimension of the actuator element is varied in the active direction.

3. An ink jet recording device as claimed in claim 2, characterized in that the plurality of ducts comprises first and second ducts provided at the first face of the chamber plate and third and fourth ducts provided at the second face of the chamber plate, the second, fourth, sixth, etcetera pressure chambers of the first row communicating with the first duct, the second, fourth, sixth, etcetera pressure chambers of the second row communicating with the second duct, the first, third, fifth, etcetera pressure chambers of the first row communicating with the third duct, and the first, third, fifth, etcetera pressure chambers of the second row communicating with the fourth duct.

4. An ink jet recording device as claimed in claim 2, characterized in that the ducts provided at least one of the faces of the chamber plate are formed as recesses in that face of the chamber plate.

5. An ink jet recording device as claimed in claim 2, characterized in that the ducts provided at least one of the faces of the chamber plate are formed as recesses in a further plate attached to that face of the chamber plate.

6. An ink jet recording device as claimed in claim 2, characterized in that the ducts provided at least one of the faces of the chamber plate are formed as openings in an intermediate plate attached to that face of the chamber plate, the intermediate plate being sandwiched between the chamber plate and a further plate.

7. An ink jet recording device as claimed in claim 2, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

8. An ink jet recording device as claimed in claim 3, characterized in that the ducts provided at least one of the faces of the chamber plate are formed as recesses in that face of the chamber plate.

9. An ink jet recording device as claimed in claim 3, characterized in that the ducts provided at least one of the faces of the chamber plate are formed as recesses in a further plate attached to that face of the chamber plate.

10. An ink jet recording device as claimed in claim 3, characterized in that the ducts provided at least one of the faces of the chamber plate are formed as openings in an intermediate plate attached to that face of the chamber plate, the intermediate plate being sandwiched between the chamber plate and a further plate.

11. An ink jet recording device as claimed in claim 3, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

12. An ink jet recording device as claimed in claim 4, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

13. An ink jet recording device as claimed in claim 5, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

14. An ink jet recording device as claimed in claim 6, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

15. An ink jet recording device as claimed in claim 8, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

16. (Amended) An ink jet recording device as claimed in claim 9, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

17. An ink jet recording device as claimed in claim 10, characterized in that the chamber plate has a direction of thickness extending from said first to said second face and is formed as a multilayer plate comprising at least one layer of piezoelectric material sandwiched between layers of electrode material, an actuator element being formed in the chamber plate for each pressure chamber in that plate, the active direction of the actuator elements coinciding with the direction of the thickness of the chamber plate.

* * * * *